United States Patent [19]

Van Seenus

[11] 3,950,026

[45] Apr. 13, 1976

[54] CHAIR OR A WHEELED CHAIR

[76] Inventor: Robert Johannes Van Seenus, 23, Onder den Doel, Blaricum, Netherlands

[22] Filed: Mar. 14, 1974

[21] Appl. No.: 451,132

[30] Foreign Application Priority Data

July 6, 1973 Netherlands ..... 7309461

[52] U.S. Cl. ..... 297/328; 297/115; 297/383; 297/384; 297/411

[51] Int. Cl.[2] ..... A47C 1/02

[58] Field of Search ..... 297/115, 328, 376, 384, 297/390, 344, 346, 375, 411, 383, 412, 433, 354, 355; 269/328

[56] References Cited

UNITED STATES PATENTS

| | | | |
|---|---|---|---|
| 667,869 | 2/1901 | Davidson | 297/328 |
| 787,873 | 4/1905 | Brownell | 297/376 |
| 1,571,509 | 2/1926 | Connolly | 297/375 |
| 1,685,770 | 10/1928 | Bowen | 297/383 X |
| 1,714,462 | 5/1929 | De Veau | 297/383 X |
| 1,892,048 | 12/1932 | Genung | 297/412 |
| 2,358,265 | 9/1944 | Thomas | 297/411 X |
| 2,585,447 | 1/1952 | Eichorst | 297/376 |
| 2,694,437 | 11/1954 | Glaser | 297/384 X |
| 2,696,868 | 12/1954 | Miller | 297/411 X |
| 3,140,119 | 7/1964 | Offner | 297/115 X |
| 3,640,571 | 2/1972 | Keropian | 297/384 |
| 3,650,523 | 3/1972 | Darby | 269/328 |

FOREIGN PATENTS OR APPLICATIONS

| | | | |
|---|---|---|---|
| 323,296 | 1/1930 | United Kingdom | 297/383 |

*Primary Examiner*—James C. Mitchell
*Attorney, Agent, or Firm*—Stevens, Davis, Miller & Mosher

[57] ABSTRACT

A chair or wheelchair for infirm patients, principally comprising a frame for the support of a seat, a backrest, arm- and feet-supports, in which the seat is rotatably mounted in the frame, the backrest is rotatable in a plane at right angles to the seat and likewise can be moved parallel to the seat, the arm-supports can be slidably moved in two directions extending at right angles to each other, and the feet-support is rotatable around a hinge at the front side of the seat. The seat has a sleeve at its lateral sides provided with an ear to which a tap is fixed, which tap is supported in an upright post of the frame, whereas at the rearward side of the seat a plunger of a pneumatic spring is secured, the cylinder of which is rotatably mounted to the frame.

7 Claims, 7 Drawing Figures

Fig: 5.
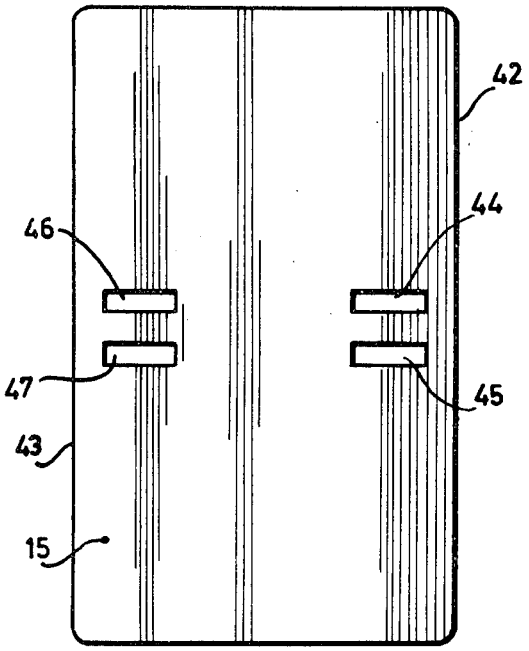
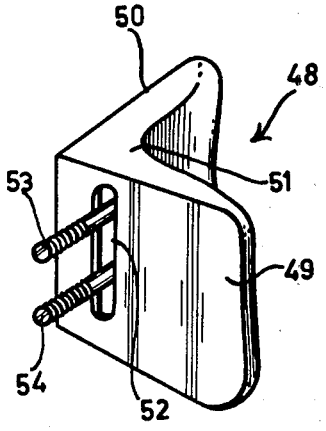
Fig: 6.
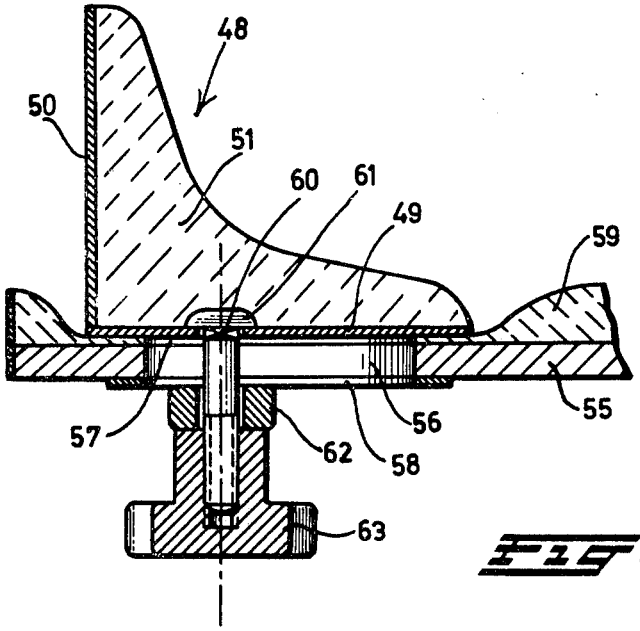
Fig: 7.

CHAIR OR A WHEELED CHAIR

The present invention relates to a chair or a vehicle for infirm patients, more especially to a chair or wheelchair (vehicle) adaptable to a large number of physical deformities and defects which are often of a permanent character.

The chair or wheelchair of the invention, hereafter generically chair, principally consists of a frame supporting a seat, a backrest and supporting parts for arms and legs (feet). In order to attain the desired adjustment according to the invention the seat of the chair is mounted in the frame for pivotal movement around an axis parallel to it, the backrest being rotatable in a plane at right angles to the seat; in addition the backrest of the chair can be moved parallel to the seat whereas the armrests are slidable in two extending directions at right angles to each other and the supporting part for the feet may swing round a hinge at the front of the seat.

In order to make the seat adjustable with respect to the frame the seat is laterally provided with a socket with an ear having a pin connected to it, which pin is secured to an upright post of the frame; whereas at the back of the seat a plunger of a pneumatic spring is connected, the cylinder of which is rotatable in the frame.

The above-mentioned adjustability of the backrest is obtained through a sleeve which slides along the lateral sides of the seat and which is provided with a disc standing at right angles to it; the backrest may be rotated with respect to the disc and fixed in the desired position.

The disc is also provided with a pin standing at right angles to it, forming a pivotal point for a strip secured to the side-edge of the backrest, which strip is extended past the pivotal point and at its end is provided with a clamping device, extending into an arcuate channel (groove), the center of which is coincident with said pivotal point.

The invention further relates to a chair provided with an adjustable backrest.

For infirm patients with anatomical deformities of the back it is very important that weaker parts of the body are sufficiently supported in a sitting position. In many cases one manages with cushions in order to obtain the required adjustment but this is troublesome since, due to the movement of the patient, cushions do not stay in their places.

A rather expensive solution of the problem would be adjusting the backrest to the shape and requirements of each patient individually. This means that in an institution there must be available as many differently shaped backrests as there are patients with mutually different requirements for support of the body.

Also with respect to the build of patients there are many differences which cannot always easily be compensated.

A further purpose of the invention is to eliminate the above-mentioned objections and to provide a chair or wheelchair for infirm patients, which may be adjusted in a quick and efficient way to the build and requirements of a particular patient.

For this purpose the backrest is provided with side-supports near the longitudinal boundaries which are adjustably secured to the backrest.

In order to realize said adjustability there are provided channels which extend away from the sides of the backrest towards each other, through which side-support pins extend.

In this way it will be possible to move said side-supports separately or jointly in a transverse direction. Additionally it will be possible to rotate each of the supports, if some clearance is allowed to the pins extending into the channels.

By providing the pins with threads for mounting a winged nut or the like, each side-support may be tightened in its proper position.

The side-support which is used is initially a loose part. This is defined by two surfaces disposed principally at right angles to each other, in which one of said surfaces is provided with fixing pins in order to fix the side-support in the channels of the backrest, which surfaces are connected by a surface provided with an upholstering contoured to fit against the human body.

With any large deviations it will be possible to adapt the upholstering to individual needs. The upholstery is constructed so that is smoothly passes into the backrest.

Height-adjustment of each side-support will be possible in that the fixing pins are slidably engaged in a slot or channel, which extends principally parallel to the intersecting line of the surfaces disposed principally at right angles to each other, in which channel a flat part of the pins extends, whereas each pin is provided with a head lying against the upholstery.

The flat part of the fixing pin prevents rotation of same in the channel whereas the head lying against the upholstery prevents movement in its longitudinal direction.

The invention will be more fully described with respect to the enclosed drawing, wherein:

FIG. 5 is a front view of a backrest for a chair according to the invention, in which the side-supports are left out;

FIG. 6 is a perspective, rear view of one of the side-supports and

FIG. 7 is a sectional view, showing the fixing of a side-support to the backrest.

Figure 1:
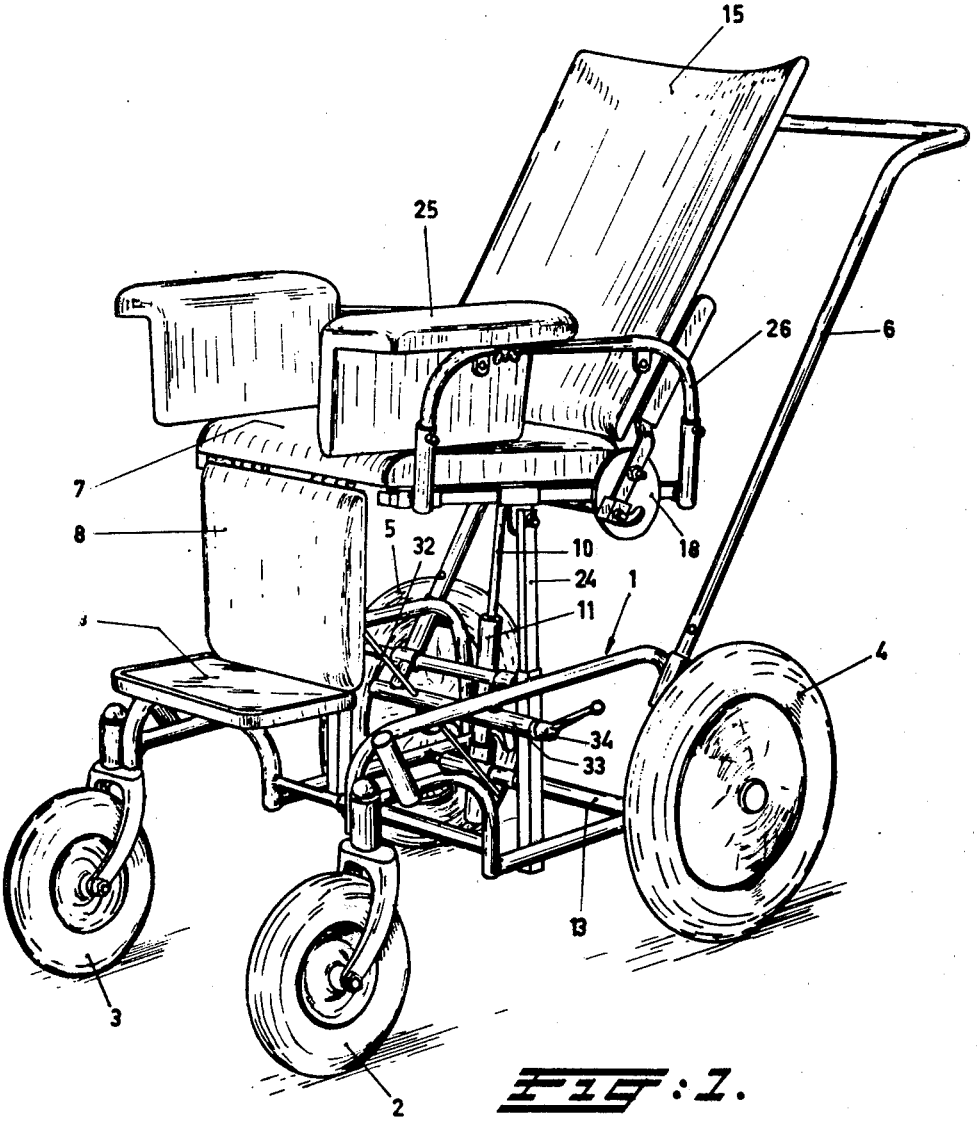
FIG. 1 is a perspective view of a chair or wheelchair for infirm patients according to the invention.

In the drawing the frame 1 provided with wheels 2, 3, 4 and 5. Instead of wheels other supporting means may be used, so that the device may serve as a stationary chair.

In the present embodiment a pushing bar 6 is mounted to the frame; it may also be mounted to the front side.

A seat part 7 has a hinge mounted at the front side for pivotal movement of feet-support 8,9.

A pneumatic spring comprising a cylinder 11 and a plunger 10 engages the rearward side of the seat 7. The cylinder 11 is slidable in a sleeve 12 (see FIG. 4) which in its turn is rotatably connected to a transverse support 13 of the frame.

Figure 4:
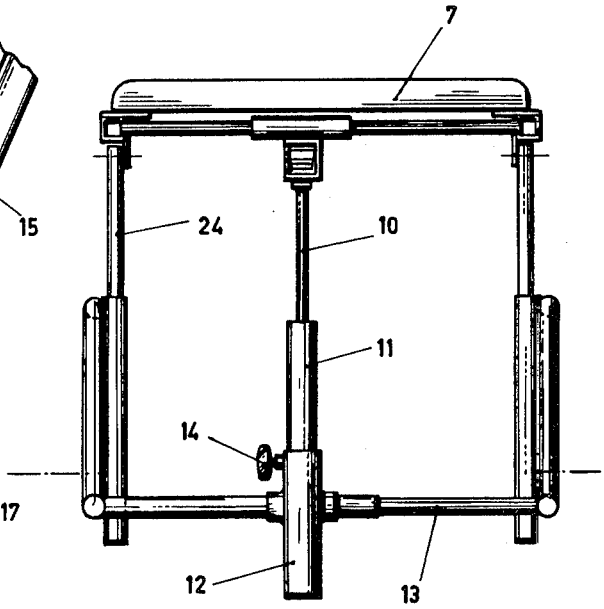
FIG. 4 is a partial rear view of the frame.
Figure 3:
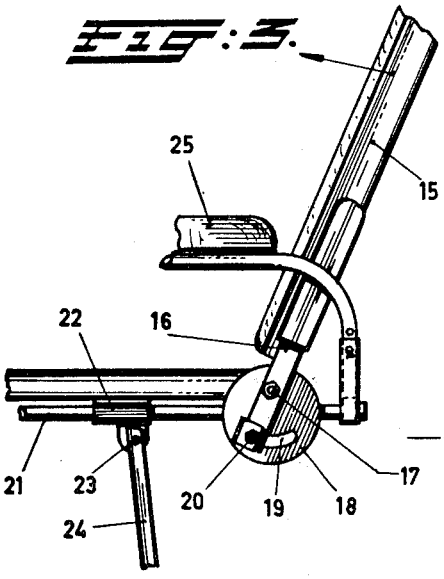
FIG. 3 is a detail of the adjustment of the backrest.

The cylinder 11 may, as indicated in FIG. 4, be fixed in the sleeve 12 by means of a winged bolt 14. By loosening the seat 7 from its pins 23 the pneumatic spring 10, 11 may be tightened or untightened by which the position of the seat in the frame 1 can be adjusted.

The backrest 15 is provided with a strip 16 at its lateral sides. Strip 16 extends up to and under the edge of the seat 7 and is provided with a pivot point 17, positioned on a disc 18; disc 18 has an arcuate channel 19, the center of which is coincident with the pivot point 17. At the lower edge the strip 16 is provided with a locking device 20, so that the backrest 15 may be fixed in any desired position. The disc 18 is slidable along a guide member 21 at the lateral edge of the seat 7, so that the backrest 15, besides being rotatable, in various angular positions, is also slidable with respect to the seat 7.

A sleeve or socket 22 is secured at the underside of the seat. Sleeve 22 has an ear in which the pivot 23 is centered around which the seat 7 can revolve in the frame 1. For that purpose the frame is provided with lateral bars 24, which are slidable and securably supported in the frame.

Figure 2:
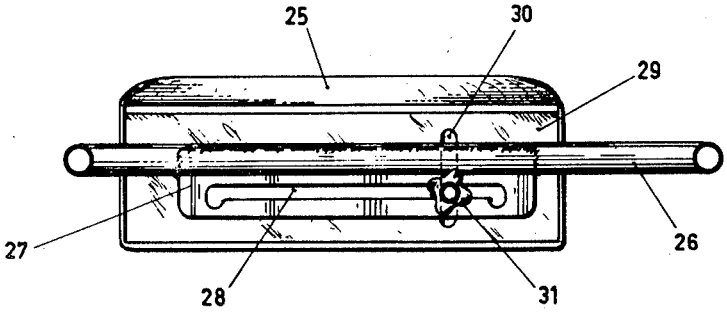
FIG. 2 is a detail of the adjustment of an arm-support.

FIG. 2 shows a bottom view of one of the two arm-supports 25. A plate 27 is fixed to the frame-part 26 and is provided with a longitudinal channel 28. The arm-support 25 has at its under side a plate 29 provided with a channel 30 extending at right angles to the channel 28. A hook bolt extends into the channel 28 and may be fixed to the arm-support 25 by means of a coupling nut 31. Since the channels 28 and 30 extend at right angles towards each other, the arm-supports 25 may be adjusted at right angles to each other in two extending directions.

A pin or similar member 32 is pivotally mounted at the rearward side of the feet-support 8,9, which pin extends through a bore in a transverse support 33 of the frame. By means of a winged nut the pin 32 can be fixed into the opening, viz. the feet-support 9,8 can be adjusted in various positions with respect to the frame 1. As will also be apparent from FIG. 1 the upper part of the frame can be loosened from the under-carriage which is for instance advantageous during transport. Furthermore the under-carriage can be telescoped into each other, in that all transversal elements are bipartite and can telescope into each other.

The backrest comprises a frame 15, to which an upholstery is applied.

The upholstery usually comprises synthetic material, for instance foam-plastic, which may be covered with leather.

Referring to FIG. 5, the back 15 has side-boundaries 42 and 43. Close to the side-edge 42 there are provided channels 44 and 45, extending at right angles to it, whereas similar channels 46 and 47 are provided near the side-edge 43. The back 15 has means, which otherwise are not further indicated, for fixing them to the frame of a wheelchair for infirm patients as shown in FIG. 1.

Each side-support 48 comprises a detachable part defined by surfaces 49 and 50 disposed principally at rights angle to each other, which in a known way are lined, for instance with leather. In the corner defined by surfaces 49 and 50 an upholstery 51 is disposed which likewise may comprise a foamy substance, covered with leather. The upholstery is so shaped that it may easily be adapted to the anatomical shape of the human body, with due allowance for any deviations. Otherwise the upholstery smoothly joins up with the upholstery at the backrest 15 so that there are no perceptible transistions.

A channel 52 is formed in surface 49 near and substantially parallel to the defining line between surfaces 49 and 50. Fastening pins 53 and 54 extend into channel 52 so that the side-support 48 can be fixed into the channels 44 and 45 or 46 and 47 respectively of the back 15.

A sectional view of said fastening is shown in FIG. 7. Channels 44–47 are encircled at either side of the frame 55 of the backrest 15 by a metal border 57 and 58. The back-upholstery is indicated by 59.

An otherwise round and threaded pin 53 has a flat part 60 which serves to prevent pin 53 from rotating in the channel 52 when the sidesupport 48 is fastened to the backrest 15. The head 61 of the pin 53 rests against the surface 49 and is surrounded by the upholstery 51 in such way that the pin 53 may slidably be moved in the channel 52 but movement of the pin 53 in its longitudinal direction is principally prohibited. A washer-sleeve 62 is provided on pin 53 and is secured by a fastening-nut 63.

By means of the channels 46–47 and 52 or 44–45 and 52, extending at right angles to each other, it will be possible to adjust the side-support 48 in two directions extending at right angles to each other. By giving the flat part 60 some clearance in the channel 52 it will likewise be possible to turn the side-support 48 somewhat, by which a very effective adaption of the position of the side-support to the body of a patient is allowed.

I claim:

1. A chair assembly for supporting infirm patients, comprising:

a frame for supporting a seat, a backrest, and arm- and feet-supports, said backrest having at least two laterally extending slots located at lateral side portions of said backrest;

means mounting said seat to said frame for pivotal movement about an axis substantially parallel to the plane of said seat;

means mounting said backrest to said seat for pivotal movement at right angles to said seat and for movement in a plane substantially parallel to the plane of said seat;

means mounting said arm supports to said seat for slidable movement in two mutually perpendicular directions parallel to the plane of said seat;

means mounting said feet supports to said seat for pivotal movement about an axis substantially parallel to the plane of said seat;

a pair of lateral side supports each having one surface containing a further slot and a pin loosely mounted in said first slot for movement within the bounds of said further slot, said pins extending through said slots in said backrest; and means engaging the portions of said pins extending through said slots in said backrest to, in a first position, secure said lateral supports against movement relative to said backrest and, in a second position, to permit adjustment of said lateral supports relative to said backrest in at least two mutually perpendicular directions.

2. A chair assembly according to claim 1, wherein said frame includes a pair of laterally displaced upright members, each having a sleeve member rotatably secured at one end portion, and said seat comprises longitudinally extending guide members passing through and slidable within said sleeve members to permit forward and backward sliding movement of said seat, the coupling between said sleeve and upright members defining the axis about which said seat is pivotable; said chair assembly further comprising a pneumatic device having a cylinder pivotably secured to said frame for movement about a pivot axis substantially parallel to the pivot axis of said seat, said pneumatic device further including a piston rod slidably mounted in said cylinder and having an end portion connected to said seat.

3. A chair assembly according to claim 2, wherein said means mounting said backrest to said seat comprises a rotation-guide member, having an arcuate slot formed therein, mounted for sliding movement to said seat guide members and a rod fixed to a lateral side portion of said backrest and movably coupled to said rotation-guide member for rotation about an axis substantially coincident with the center of curvature of said arcuate slot, said rod engaging and being guided by said slot.

4. A chair assembly according to claim 1, wherein said means mounting each of said arm supports to said seat comprises a first plate having a longitudinal slot formed therein and a second plate having a slot formed therein at right angles to the longitudinal slot in said first plate, wherein one of said plates is coupled to said frame and the other to said arm support.

5. A chair assembly according to claim 1, wherein said feet-support comprises an L-shaped member having one leg pivotably mounted to said seat and a pivot pin having one end fixed to said one leg of said L-shaped member, the other end portion of said pivot pin extending through an aperture of a transverse member of said frame, and means for securing said pivot pin to said transverse frame member in any one of a plurality of positions to fix said feet-support in any one of a corresponding plurality of positions relative to said seat.

6. A chair assembly according to claim 1, wherein each lateral support is defined by two surfaces extending principally at right angles to each other, in which one of said surfaces includes said pins for fixing the lateral support into the slots of the backrest, which surfaces are connected by a surface provided with an upholstery shaped to accommodate the human body.

7. A chair assembly according to claim 6, wherein the pins in the lateral supports each have a flat part extending into one of the further slots which extend principally parallel to the intersecting line of the surfaces extending principally at right angles to each other, whereas each pin is formed with a head in contact with the upholstery.

* * * * *